US010919249B2

(12) United States Patent
Mardikian

(10) Patent No.: US 10,919,249 B2
(45) Date of Patent: Feb. 16, 2021

(54) APPARATUS FOR PRESSING AND DEHYDRATING OF WASTE

(71) Applicant: Albert Mardikian, Corona Del Mar, CA (US)

(72) Inventor: Albert Mardikian, Corona Del Mar, CA (US)

( * ) Notice: Subject to any disclaimer, the term of this patent is extended or adjusted under 35 U.S.C. 154(b) by 693 days.

(21) Appl. No.: 15/048,513

(22) Filed: Feb. 19, 2016

(65) Prior Publication Data

US 2017/0239904 A1 Aug. 24, 2017

(51) Int. Cl.

| | |
|---|---|
| ***B30B 9/16*** | (2006.01) |
| ***B30B 9/26*** | (2006.01) |
| ***B30B 9/12*** | (2006.01) |
| ***F26B 17/20*** | (2006.01) |
| ***F26B 5/14*** | (2006.01) |

(52) U.S. Cl.

CPC ..... *B30B 9/16* (2013.01); *B30B 9/121* (2013.01); *B30B 9/26* (2013.01); *F26B 5/14* (2013.01); *F26B 17/20* (2013.01); *F26B 2200/04* (2013.01); *F26B 2200/12* (2013.01)

(58) Field of Classification Search

CPC ..... B30B 9/16; B30B 9/166; B30B 9/121

See application file for complete search history.

(56) References Cited

U.S. PATENT DOCUMENTS 808,193 A * 12/1905 Bussells ..... B30B 9/12 100/74
892,314 A * 6/1908 Anderson ..... B27B 11/00 83/755
1,625,554 A 4/1927 Leggett
1,813,750 A 7/1931 Mackenzie
2,171,949 A 9/1939 Manuel
2,609,993 A 9/1952 Rene
2,977,873 A 4/1961 Crane
3,100,143 A 8/1963 Doggett
3,136,722 A 6/1964 Gooch (Continued)

FOREIGN PATENT DOCUMENTS

CA 2082311 4/2001
CN 2279794 Y 4/1998

(Continued)

OTHER PUBLICATIONS

EffEnergy; BTU Values Mar. 2006.

(Continued)

*Primary Examiner* — Gregory D Swiatocha
(74) *Attorney, Agent, or Firm* — Patent Law Agency, LLC; Peter Ganjian

(57) ABSTRACT

Apparatus for pressing and drying a pre-defined amount of waste includes a metal main frame positioned to provide rigid support, and a body mechanically linked to the main frame through a plurality of linkage plates. The apparatus also includes an inlet vertically mounted on the body and a twin screw assembly to press and dehydrate the pre-defined amount of waste. A plurality of mesh screens is rigidly linked to the main frame along the longitudinal axis of the apparatus to remove compressed liquid. The body is also designed to support rotation of the twin screw assembly, and the inlet includes an ingress cross-sectional opening to receive the pre-defined amount of waste.

18 Claims, 11 Drawing Sheets

(56) References Cited

U.S. PATENT DOCUMENTS 3,256,807 A * 6/1966 Hunt ..... B30B 9/12 100/105
3,407,510 A 10/1968 Lewis et al.
3,473,494 A 10/1969 Siracusa
3,506,414 A 4/1970 Skendrovic
3,563,399 A 2/1971 Shivers
3,707,070 A * 12/1972 Chaplin ..... A01D 44/00 56/1
3,777,680 A 12/1973 Eck
3,817,259 A 6/1974 Strasser et al.
3,845,220 A 10/1974 Suzuki
3,945,575 A 3/1976 Marsh
4,026,426 A 5/1977 Shivvers
4,026,678 A 5/1977 Livingston
4,046,325 A 9/1977 Tucsok
4,063,903 A 12/1977 Beningson et al.
4,151,959 A 5/1979 Deister
4,192,746 A 3/1980 Arvanitakis
4,217,061 A 8/1980 Eiland et al.
4,458,428 A 7/1984 Saeman
4,479,048 A 10/1984 Kinoshita
4,559,720 A 12/1985 Marquardt
4,565,124 A 1/1986 Stautland et al.
4,644,664 A 2/1987 Bradshaw
4,884,353 A 7/1989 Houle
4,922,989 A 5/1990 Backlund
5,001,975 A 3/1991 Finden
5,105,555 A 4/1992 Nakagomi
5,169,728 A 12/1992 Murphy et al.
5,181,432 A 1/1993 Allen
5,265,347 A 11/1993 Woodson et al.
5,277,760 A * 1/1994 Fongen ..... D21C 3/026 162/19
5,387,267 A 2/1995 Warf
5,454,521 A 10/1995 Frazier et al.
5,570,517 A 11/1996 Lucker
5,651,305 A * 7/1997 Bushman ..... A21C 1/065 100/145
5,743,178 A 4/1998 Babbini
5,971,305 A 10/1999 Davenport
6,089,169 A 7/2000 Comiskey
6,692,544 B1 2/2004 Grillenzoni
7,252,691 B2 8/2007 Philipson
7,267,049 B2 * 9/2007 Babbini ..... B30B 9/16 100/117
7,520,457 B1 4/2009 Poitras et al.
7,521,076 B1 * 4/2009 Wenger ..... A23N 17/005 426/510
D609,042 S 2/2010 Wilmsen
7,993,048 B1 8/2011 Collette et al.
8,043,505 B2 10/2011 Noguchi et al.
8,043,558 B2 10/2011 Chambe et al.
8,714,467 B2 5/2014 Lucas
9,423,178 B2 8/2016 Mardikian
9,744,574 B2 8/2017 Cathcart
2005/0274035 A1 12/2005 Beal et al.
2006/0130353 A1 6/2006 Eloo
2006/0272518 A1 * 12/2006 Babbini ..... B01D 29/117 100/145
2006/0288884 A1 12/2006 Babbini
2007/0164139 A1 7/2007 Lipowski et al.
2007/0221362 A1 9/2007 Stewart et al.
2008/0105141 A1 * 5/2008 Duperon ..... B30B 9/121 100/106
2008/0233310 A1 9/2008 Fujita
2009/0060779 A1 3/2009 Chambe et al.
2009/0090282 A1 4/2009 Gold et al.
2010/0043246 A1 2/2010 Smith et al.
2010/0179315 A1 7/2010 Medoff
2010/0237289 A1 9/2010 Self et al.
2010/0281767 A1 11/2010 Zeeck
2010/0293846 A1 11/2010 Shaffer
2010/0300368 A1 12/2010 Myers et al.
2010/0304439 A1 12/2010 Medoff
2010/0304440 A1 12/2010 Medoff
2011/0041390 A1 2/2011 Flick et al.
2011/0248109 A1 10/2011 Lesar et al.
2012/0145815 A1 6/2012 Koenig
2012/0245257 A1 9/2012 Fascio
2013/0029394 A1 1/2013 Toll et al.
2013/0205613 A1 8/2013 Mardikian
2013/0306763 A1 11/2013 Carmell
2014/0061340 A1 3/2014 Castronovo
2014/0076693 A1 3/2014 Pankoke
2014/0144042 A1 5/2014 Wechsler
2014/0144823 A1 * 5/2014 Marchesini ..... B01D 29/356 210/120
2014/0166794 A1 6/2014 Kaljunen
2014/0183022 A1 7/2014 Daugaard
2014/0217214 A1 8/2014 Peterson
2014/0223810 A1 8/2014 Nordin
2014/0224905 A1 8/2014 McKee et al.
2014/0231560 A1 8/2014 Lucas et al.
2014/0259895 A1 9/2014 Mason
2015/0276312 A1 10/2015 Mardikian
2017/0107447 A1 4/2017 Hewitt

FOREIGN PATENT DOCUMENTS

CN 101365548 A 2/2009
CN 201350703 Y 11/2009
CN 202037167 U 11/2011
CN 202643524 U 1/2013
CN 203095009 U 7/2013
CN 203124392 U 8/2013
DE 3015523 A1 10/1981
DE 102011086615 A1 * 5/2013 ..... B30B 9/26
EP 0 358 837 A1 3/1990
EP 0358837 A1 3/1990
EP 0358837 B1 3/1994
EP 0722486 A1 7/1996
EP 1 331 442 A1 7/2003
EP 1 663 632 B1 6/2006
JP S50158970 A 12/1974
JP 58097498 A * 6/1983 ..... B30B 9/12
JP 60223698 A * 11/1985 ..... B30B 9/12
JP H 09 273066 A 3/1990
JP H 08 294700 A 4/1990
JP 08-215669 8/1996
JP 2000325914 A 11/2000
JP P2001179492 A 7/2001
JP P2001340998 A 12/2001
JP 2003033896 A 2/2003
JP P2008524553 A 7/2008
JP 2009522081 A 1/2009
JP P2010149094 A 7/2010
JP 2012-176411 A 1/2012
JP P201318020 A 1/2013
KR 20020038427 A * 5/2002 ..... B30B 9/26
WO WO 91/06816 A1 5/1991
WO WO9106816 5/1991
WO WO-9106816 A1 * 5/1991 ..... F26B 7/00
WO WO2004022510 3/2004
WO WO-2015189271 A1 * 12/2015 ..... B30B 9/26

OTHER PUBLICATIONS

Jordan Reduction Solutions ; Twin Shaft Shredders; http://www.jordanreductionsolutions.com.
http://www.kunsheng.com.tw/equipments.html website.
"Pelletizing rather than refining" ; Sun & Wind Energy, Sep. 2010; pp. 242 to 246.
WO 2004/080704 A1 ; Sep. 23, 2004 ; Atlas-Stord Denmark A/S.
Keyway—Keyseat; Nov. 29, 2014 ; Avneesh Khanna.
IAC Publishing, LLC; 2017 ; How Does Humidity Affect Static Electricity.
File Hisotry of U.S. Appl. No. 14/242,453, filed Apr. 1, 2014; Mardikian; Includes JP 550158970A.
PCT/US2016/047221 ; Filed: Aug. 16, 2016; File History, ISR, and Opinion; WO 2017/127135—Jul. 27, 2017.
PCT/US2016/049311 ; Filed Aug. 29, 2016; File History, ISR, and Opinion; WO 2017/127137—Jul. 27, 2017.

(56) References Cited

OTHER PUBLICATIONS

PCT/US2016/051185 ; Fled Sep. 10, 2016 ; File History, ISR, and Opinion; WO 2017/142592—Aug. 24, 2017.
PCT/US2017/018513 ; Filed Feb. 17, 2017 ; File History, ISR, and Opinion ; WO2017/143293—Aug. 24, 2017.
WO 91/06816 A1 (AKT Consultants Pty Limited) May 16, 1991.
Examination Report From Australian Patent Office Regrading Australian Patent Application 2017221474; dated May 16, 2019; (U.S. Appl. No. 15/436,554 to Albert Mardikian).
Australian Patent Application Office Action for Australian Patent Application: 2016388325; dated Apr. 4, 2019.
Australian Patent Application Office Action for Australian Patent Application: 2016393244; dated Apr. 4, 2019.
EPO Search Report; EPO Application: 16886766.1 Office Action Report dated Aug. 21, 2019.
EPO Search Reports; EPO Application: 17753997.0 Office Actions Report dated Sep. 13, 2019.
Canada Search/Examiner Report for; Application No. 3,011,564; dated Jul. 5, 2019.
Canada Search/Examiner Report for; Application No. 3,011,571; dated Jul. 16, 2019.
Canada Search/Examiner Report for; Application No. 3,011,621; dated Jul. 16, 2019.
China Case 201680079485.5 Office Action From China Patent Office for U.S. Appl. No. 15/001,091, filed Jan. 19, 2016, Now U.S. Pat. No. 10,071,405, dated Sep. 11, 2018.
China Case PA 201680081044.9 Office Action From China Patent Office for U.S. Appl. No. 15/048,513, filed Feb. 19, 2016.
European Patent Application EP 16 89 0868.9 Office Action dated Sep. 11, 2019; U.S. Appl. No. 15/048,513, filed Feb. 19, 2016.
EPO Office Action dated Sep. 18, 2019; for Case 16890868.9; Albert Mardikian EPO Version of the U.S. Case 158/048,513 Filed Feb. 19, 2016.
JP 2018-537656 Office Action dated Jul. 1, 2020.
JP 2018-556785 Office Action dated Jul. 1, 2020.
Office Action from JPO for application related to U.S. Appl. No. 15/048,513; dated Jun. 9, 2020.
Office Action from EPO for application related to U.S. Appl. No. 15/048,513; dated Feb. 1, 2020.
Office Action from CN for application related to U.S. Appl. No. 15/048,513; dated Mar. 18, 2020.
Office Action From Japan Case 2018-537656; dated Oct. 12, 2020; See U.S. Appl. No. 15/436,554 filed Feb. 17, 2017 and U.S. Appl. No. 16/774,600 filed Jan. 28, 2020 and U.S. Appl. No. 16/669,752 filed Oct. 31, 2019.
Office Action from India case 201827029605; dated Oct. 2, 2020; See U.S. Appl. No. 15/001,091 filed Jan. 19, 2016.

* cited by examiner

APPARATUS FOR PRESSING AND DEHYDRATING OF WASTE

BACKGROUND

The present disclosure relates to a field of waste management. More specifically, the present disclosure relates to an apparatus to press and dehydrate waste.

In the recent years, the amount of waste has increased sharply. This increase can be attributed to factors such as increased demand and production of livestock and agricultural produce, mismanagement of livestock and agricultural produce, lack of proper waste management resources and the like. The waste primarily includes municipal waste, green waste, organic waste and the like. This waste occupies large sections of land. This waste does not decompose properly and affects the soil quality, air quality and water resource present in the vicinity. In addition, this waste is wet, has a bad odor and contains harmful bacteria. In addition, this occupancy of waste poses negative psychological impact on the neighborhood. To overcome this, the waste is pressed and dehydrated. In conventional treatment methods, the waste obtained from municipal dump areas is commonly transferred to multiple chambers equipped with helical ridges housed in large mechanical structures.

In the prior art, an apparatus is provided for dehydrating the pre-defined amount of waste using a screw press with a shear panel formed separately to remove liquid content. The apparatus using a screw press with a shear panel which is separately formed comprises a central shaft, a screw, a plurality of shear panels, and a shear blade. The screw is formed in a spiral shape on the outer circumference of the central shaft and dehydrates sludge by generating a compressive force as the sludge is transferred when the central shaft rotates.

The shear panel is separated from the central shaft to be aligned to the outside of the screw and is fixed to the screw. The shear blade removes sludge solid bodies blocking a drum mesh or a perforated hole as the central shaft in which the screw is attached rotates.

Other prior art include an apparatus that provides for mechanically dewatering municipal sewage sludge or peat. The under watered feed material is passed into the first end of a cylindrical porous wall and pressurized within the cylindrical wall by a rotating screw conveyor, which also transports the solids toward the second end of the cylindrical wall. The screw conveyor comprises a central shaft which has at least two built-up sections of gradually increasing diameter providing a compression ratio of 2.5:1.0. The flight depth of the screw conveyor increases by a factor greater than 2.0 after each built-up section. The distance between the edge of the screw conveyor blade and the inner surface of the cylindrical wall and the structure of the openings in the wall have specific dimensional limitations. Fibrous additives may be used to aid in dewatering peat and secondary sludge.

Other prior art include an apparatus that provides for de-watering waste. A main shaft is rotated about a longitudinal axis at a first rate. A screw shaft coupled to the main shaft is rotated about the longitudinal axis at the first rate. Screw flighting coupled to the screw shaft is rotated about the longitudinal axis at the first rate. A first and second stage drum is rotated about the longitudinal axis at a second rate. Waste is introduced to a first area defined by an outer surface of the screw shaft and an inner surface of the first stage drum. Moisture is removed from the waste through a first slot coupled to the first stage drum. The waste is transported with the screw fighting from the first area to a second area defined by an outer surface of the screw shaft and an inner surface of the second stage drum, the second area being larger than the first area. Moisture is removed from the waste through a second slot coupled to the second stage drum.

Other prior art include, an apparatus that provides for separating waste liquid and solid material. The apparatus includes an upwardly inclined passage containing an auger for conveying the solid waste material upwardly along the passage, with an inlet opening at a lower end of the passage for receiving a mixture of waste liquid and solid material into the auger. In addition, the apparatus includes a drainage opening at the lower end of the cylindrical passage for draining liquid from the solid waste conveyed by the auger. In addition, the apparatus includes a compactor for receiving the solid material fed upwardly by the auger and compacting the solid waste material. An extruder receives and extrudes the compacted solid waste material from the compactor, and may be arranged to convert the compacted material into pellets.

The prior art has several disadvantages. The apparatus mentioned in these prior arts have lower efficiency levels. Further, these apparatus have high fuel consumption and increased energy costs associated with inefficient operation. In addition, these apparatus fail to accommodate materials with non-uniform initial moisture content. In addition, these apparatuses require large size chambers for accommodating organic waste. This consequent space requirements poses difficulty in transporting, assembling and placing the apparatus in operation, particularly in remote locations. These apparatus are generally complex, require much manpower and are operationally uneconomical.

SUMMARY

In an aspect, the present disclosure provides an apparatus for pressing and dehydrating a pre-defined amount of waste. The apparatus includes a main frame positioned for providing a rigid support to the apparatus. Further, the apparatus includes a body mechanically linked to the main frame through a plurality of linkage plates. Furthermore, the apparatus includes an inlet vertically mounted on the body. Further, the apparatus includes a twin screw assembly mounted on the main frame and horizontally positioned for rotation along a longitudinal axis of the apparatus. Further, the apparatus includes a plurality of mesh screens rigidly linked to the main frame along the longitudinal axis of the apparatus. Moreover, the main frame is a metallic main frame. In addition, the body is designed to support rotation of the twin screw assembly. Further, the inlet has an ingress cross-sectional opening to receive the pre-defined amount of waste. In addition, the inlet has an egress cross-sectional opening to transfer the pre-defined amount of waste to the twin screw assembly. Further, the body includes a plurality of vertical rigid supports mounted perpendicular to the longitudinal axis of the apparatus. The plurality of vertical rigid supports is mounted vertically to the main frame. In addition, the plurality of vertical rigid supports provides vertical support to the apparatus. Moreover, the body includes one or more horizontal rigid supports mounted horizontally along the longitudinal axis of the apparatus. Furthermore, the twin screw assembly is configured to press and dehydrate the pre-defined amount of waste. Further, each mesh screen of the plurality of mesh screens includes a plurality of fishers for removing compressed liquid. In addition, the plurality of mesh screens encapsulates the twin screw assembly.

In an embodiment of the present disclosure, the main frame includes a first section for holding a driving unit and a second section for holding the body.

In an embodiment of the present disclosure, the twin screw assembly includes a first screw and a second screw positioned along the longitudinal axis of the apparatus. The first screw and the second screw are mechanically coupled to a driving shaft of the driving unit through a chain and sprocket assembly. Moreover, the first screw and the second screw include a first end and a second end. In addition, the first end is a near end and the second end is a far end. In addition, the twin screw assembly includes a plurality of helical ridges rigidly mounted on the first screw and the second screw. In addition, each helical ridge of the plurality of helical ridges has a pre-defined progressive pitch varying from the first end to the second end.

In an embodiment of the present disclosure, the pre-defined progressive pitch is 120° at the first end. In addition, the pre-defined progressive pitch is 95° at the second end.

In an embodiment of the present disclosure, the driving unit is positioned adjacent to the body. In addition, the driving unit is mounted on the first section of the main frame. Moreover, the driving unit is coupled to the chain and sprocket assembly.

In an embodiment of the present disclosure, the driving unit is an electric motor assembly.

In another embodiment of the present disclosure, the driving unit is an engine assembly.

In an embodiment of the present disclosure, the plurality of mesh screens includes a primary mesh screen and a secondary mesh screen. The secondary mesh screen surrounds the primary mesh screen circumferentially. Moreover, the plurality of mesh screens is a stainless steel mesh screen.

In an embodiment of the present disclosure, the primary mesh screen includes a first plurality of apertures of the plurality of apertures. The first plurality of apertures has a first pre-defined nominal diameter range. In addition, the first pre-defined nominal diameter range is 2 mm- 4 mm.

In an embodiment of the present disclosure, the secondary mesh screen includes a second plurality of apertures of the plurality of apertures. The second plurality of apertures has a second pre-defined nominal diameter range. In addition, the second pre-defined nominal diameter range is 6 mm-8 mm.

In an embodiment of the present disclosure, the apparatus includes an outlet to expel a processed waste. Moreover, the outlet is positioned at the second end.

In another aspect, the present disclosure provides an apparatus for pressing and dehydrating a pre-defined amount of waste. The apparatus includes a main frame positioned for providing a rigid support to the apparatus. Further, the apparatus includes a body mechanically linked to the main frame through a plurality of linkage plates. Furthermore, the apparatus includes an inlet vertically mounted on the body. Further, the apparatus includes a twin screw assembly mounted on the main frame and horizontally positioned for rotation along a longitudinal axis of the apparatus. Further, the apparatus includes a plurality of mesh screens rigidly linked to the main frame along the longitudinal axis of the apparatus. Moreover, the main frame is a metallic main frame. In addition, the body is designed to support rotation of a twin screw assembly. Further, the inlet has an ingress cross-sectional opening to receive the pre-defined amount of waste. In addition, the inlet has an egress cross-sectional opening to transfer the pre-defined amount of waste to the twin screw assembly. Further, the body includes a plurality of vertical rigid supports mounted perpendicular to the longitudinal axis. The plurality of vertical rigid supports is mounted vertically to the main frame. In addition, the plurality of vertical rigid supports provides vertical support to the apparatus. Moreover, the body includes one or more horizontal rigid supports mounted horizontally along the longitudinal axis of the apparatus. Further, the twin screw assembly is configured to press and dehydrate the pre-defined amount of waste. The twin screw assembly includes a first screw and a second screw positioned along the longitudinal axis of the apparatus. The first screw and the second screw are mechanically coupled to a driving shaft of a driving unit through a chain and sprocket assembly. Moreover, the first screw and the second screw include a first end and a second end. In addition, the first end is a near end and the second end is a far end. Furthermore, the twin screw assembly includes a plurality of helical ridges rigidly mounted on the first screw and the second screw. In addition, each helical ridge of the plurality of helical ridges has a pre-defined progressive pitch varying from the first end to the second end. Further, each mesh screen of the plurality of mesh screens includes a plurality of fishers to remove compressed liquid from the pre-defined amount of waste. In addition, the plurality of mesh screens encapsulates the twin screw assembly.

In an embodiment of the present disclosure, the pre-defined progressive pitch is 120° at the first end. In addition, the pre-defined progressive pitch is 95° at the second end.

In an embodiment of the present disclosure, the plurality of mesh screens includes a primary mesh screen and a secondary mesh screen. The secondary mesh screen surrounds the primary mesh screen circumferentially. Moreover, the plurality of mesh screens is a stainless steel mesh screen In an embodiment of the present disclosure, the primary mesh screen includes a first plurality of apertures of the plurality of apertures. The first plurality of apertures has a first pre-defined nominal diameter range. In addition, the first pre-defined nominal diameter range is 2 mm-4 mm.

In an embodiment of the present disclosure, the secondary mesh screen includes a second plurality of apertures of the plurality of apertures. The second plurality of apertures has a second pre-defined nominal diameter range. In addition, the second pre-defined nominal diameter range is 6 mm-8 mm.

In an embodiment of the present disclosure, the apparatus includes an outlet to expel a processed waste. Moreover, the outlet is positioned at the second end.

In yet another aspect, the present disclosure provides an apparatus for pressing and dehydrating a pre-defined amount of waste. The apparatus includes a main frame positioned for providing a rigid support to the apparatus. Further, the apparatus includes a body mechanically linked to the main frame through a plurality of linkage plates. Furthermore, the apparatus includes an inlet vertically mounted on the body. Further, the apparatus includes a twin screw assembly mounted on the main frame and horizontally positioned for rotation along a longitudinal axis of the apparatus. Further, the apparatus includes a plurality of mesh screens rigidly linked to the main frame along the longitudinal axis of the apparatus. Moreover, the main frame has a plurality of balance points. Also, the main frame is a metallic main frame. In addition, the main frame has a first section for holding a driving unit and a second section for holding the body. In addition, the body is designed to support rotation of the twin screw assembly. The body includes a plurality of vertical rigid supports mounted perpendicular to the longitudinal axis of the apparatus. The plurality of vertical rigid supports is mounted vertically to the main frame. In addition, the plurality of vertical rigid supports provides vertical support to the apparatus. Moreover, the body includes one or more horizontal rigid supports mounted horizontally along the longitudinal axis of the apparatus. In addition, the body is designed to support rotation of the twin screw assembly. Further, the inlet has an ingress cross-sectional opening to receive the pre-defined amount of waste. In addition, the inlet has an egress cross-sectional opening to transfer the pre-defined amount of waste to the twin screw assembly. Further, the twin screw assembly is configured to press and dehydrate the pre-defined amount of waste. The twin screw assembly includes a first screw and a second screw positioned along the longitudinal axis of the apparatus. The first screw and the second screw are mechanically coupled to a driving shaft of the driving unit through a chain and sprocket assembly. Moreover, the first screw and the second screw include a first end and a second end. In addition, the first end is a near end and the second end is a far end. Furthermore, the twin screw assembly includes a plurality of helical ridges rigidly mounted on the first screw and the second screw. In addition, each helical ridge of the plurality of helical ridges has a pre-defined progressive pitch varying from the first end to the second end. Moreover, the pre-defined progressive pitch is 120° at the first end. In addition, the pre-defined progressive pitch is 95° at the second end. Further, each mesh screen of the plurality of mesh screens includes a plurality of fishers to remove compressed liquid from the pre-defined amount of waste. In addition, the plurality of mesh screens encapsulates the twin screw assembly. Moreover, the plurality of mesh screens includes a primary mesh screen and a secondary mesh screen. The secondary mesh screen surrounds the primary mesh screen circumferentially. In addition, the plurality of mesh screens is a stainless steel mesh screen.

In an embodiment of the present disclosure, the primary mesh screen includes a first plurality of apertures of the plurality of fishers apertures. The first plurality of apertures has a first pre defined nominal diameter range. In addition, the first pre-defined nominal diameter range is 2 mm-4 mm. Moreover, the secondary mesh screen includes a second plurality of apertures of the plurality of fishers apertures. The second plurality of apertures has a second pre-defined nominal diameter range. In addition, the second pre-defined nominal diameter range is 6 mm-8 mm.

In an embodiment of the present disclosure, the apparatus includes an outlet to expel a processed waste. Moreover, the outlet is positioned at the second end.

BRIEF DESCRIPTION OF THE DRAWINGS

Figure 1A:
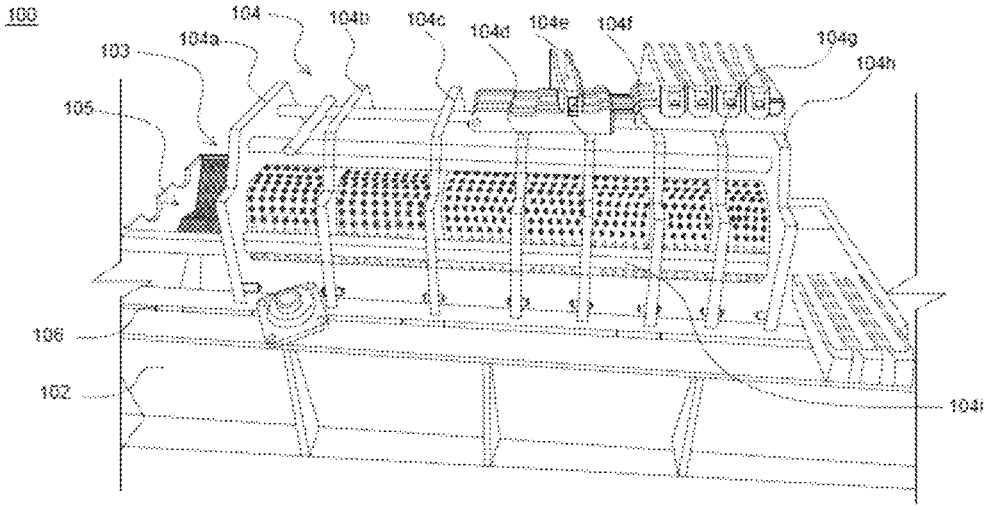
Figure 1B:
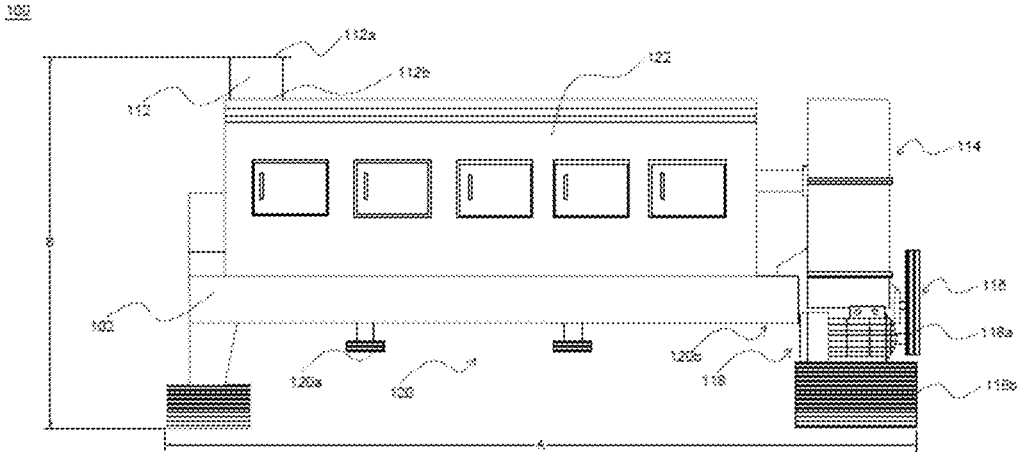
Figure 1C:
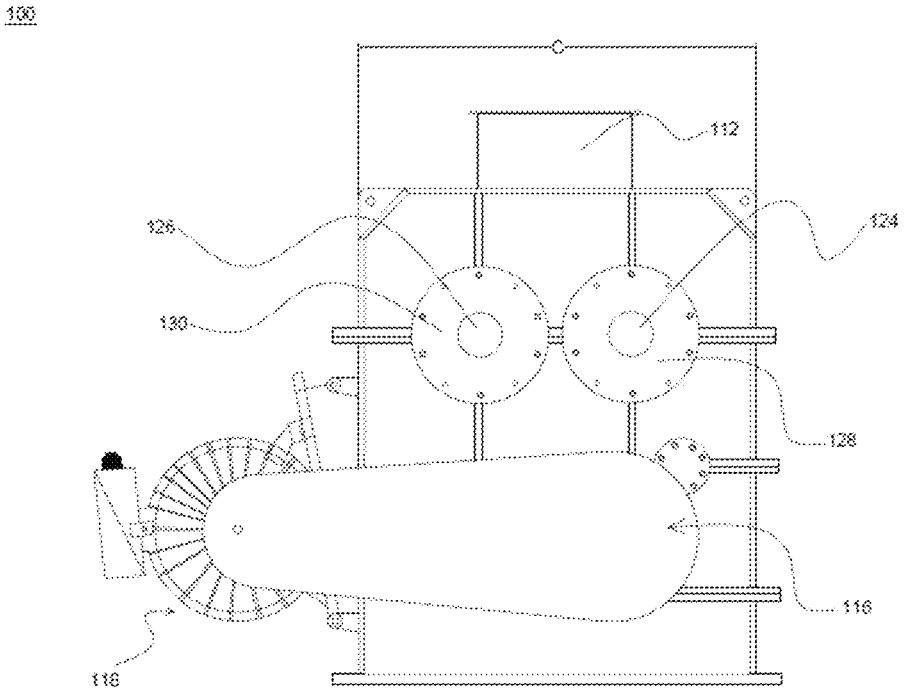
Figure 2A:
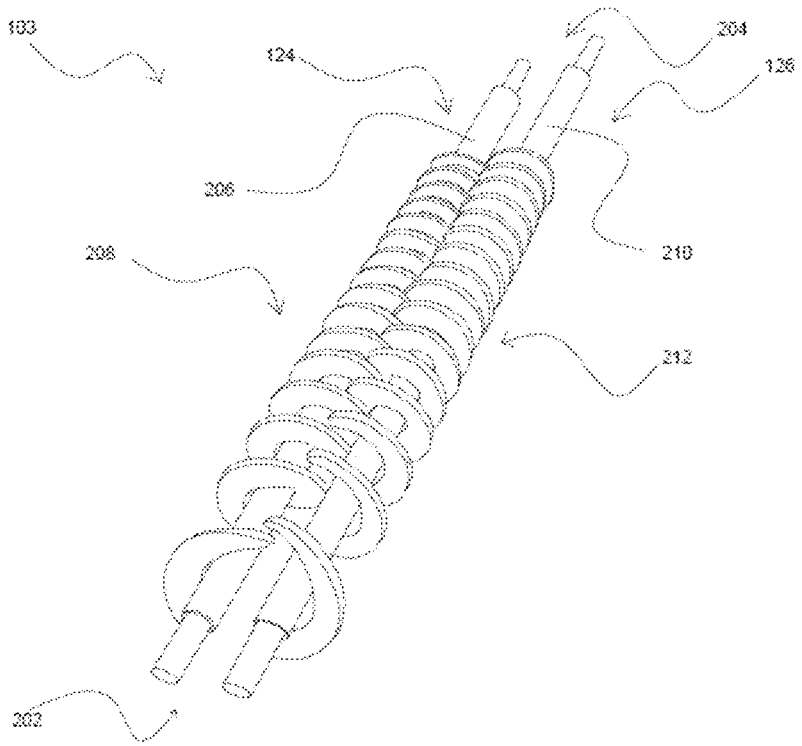
Figure 2B:
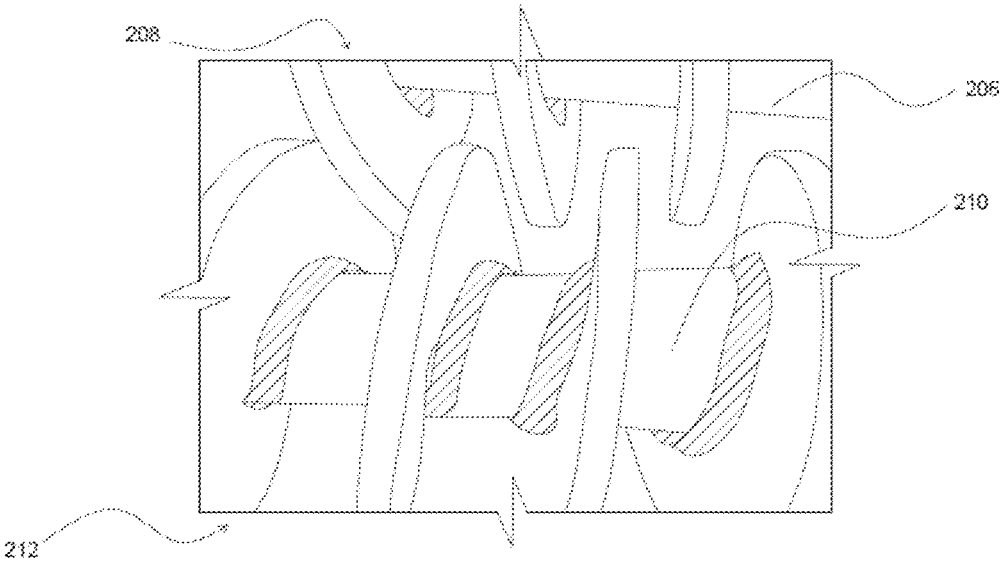
Figure 3:
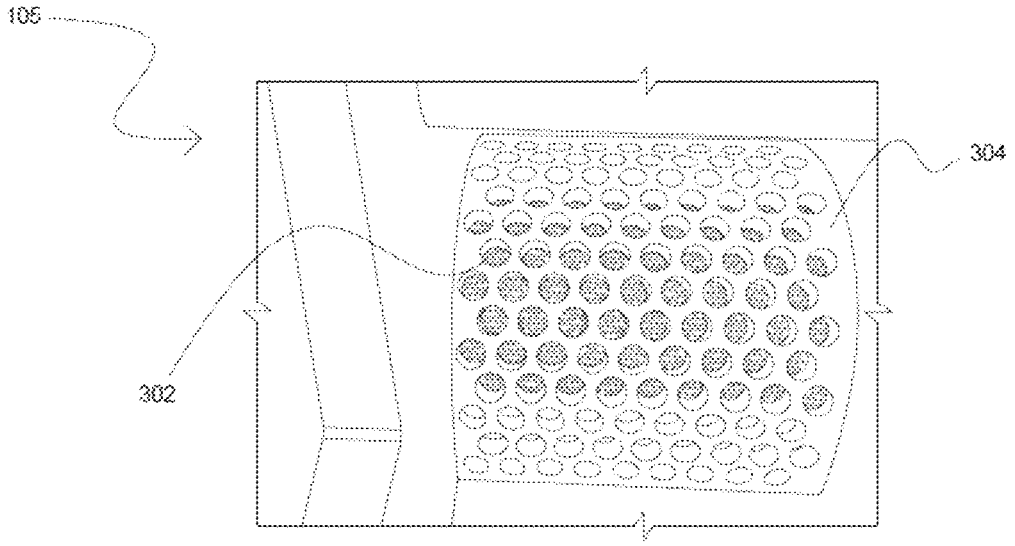
Figure 4:
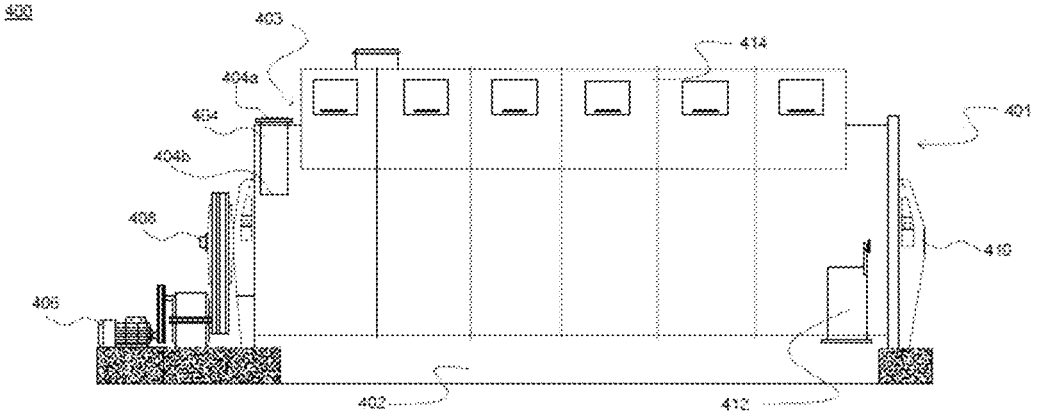
Figure 5A:
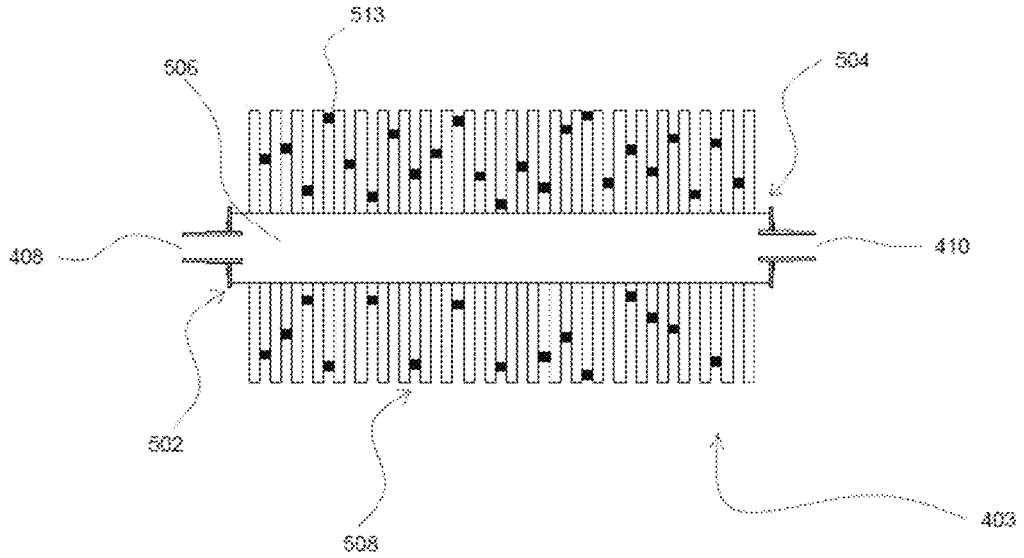

Having thus described the invention in general terms, reference will now be made to the accompanying drawings, which are not necessarily drawn to scale, and wherein:

FIG. 1A illustrates an internal perspective view of an apparatus for pressing and dehydrating a pre-defined amount of waste, in accordance with various embodiments of the present disclosure;

FIG. 1B illustrates a side profile view of the apparatus of FIG. 1A, in accordance with an embodiment of the present disclosure;

FIG. 1C illustrates a rear profile view of the apparatus of FIG. 1A, in accordance with another embodiment of the present disclosure;

FIG. 2A illustrates a perspective view of a twin screw assembly of the apparatus of FIG. 1A, in accordance with an embodiment of the present disclosure;

FIG. 2B illustrates a part perspective view of the twin screw assembly of the apparatus of FIG. 1A, in accordance with another embodiment of the present disclosure;

FIG. 3 illustrates the part perspective view of a plurality of mesh screens of the apparatus of FIG. 1A, in accordance with an embodiment of the present disclosure;

FIG. 4 illustrates a side profile view of another apparatus, in accordance with an embodiments of the present disclosure;

FIG. 5A illustrates a schematic view of a tumbler assembly of the apparatus of FIG. 4, in accordance with an embodiment of the present disclosure.

Figure 5B:
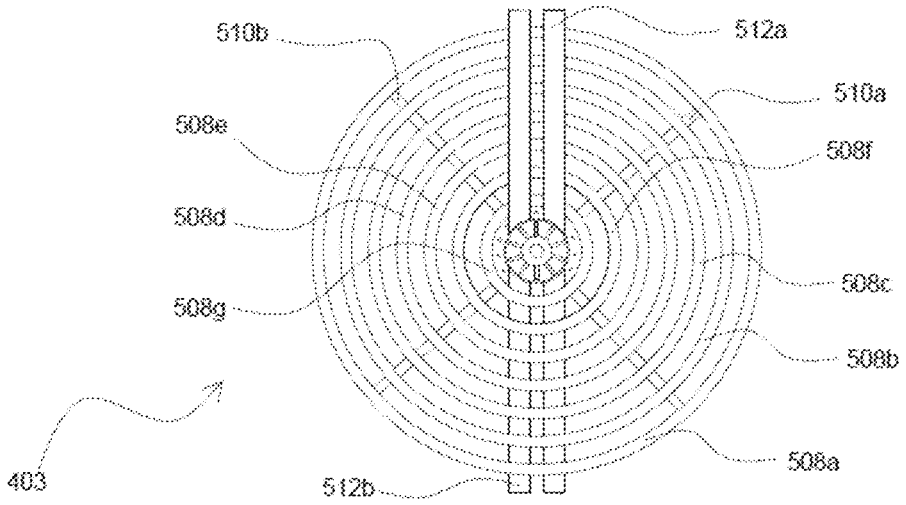

FIG. 5B illustrates a cross-sectional view of a tumbler assembly of the apparatus of FIG. 4, in accordance with an embodiment of the present disclosure.

Figure 5C:
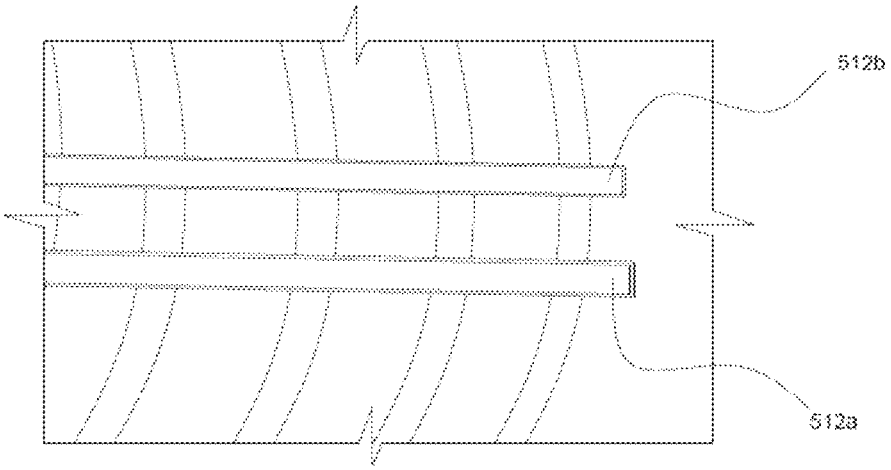

FIG. 5C illustrates the part perspective view of a tumbler assembly of the apparatus of FIG. 4, in accordance with an embodiment of the present disclosure.

Figure 5D:
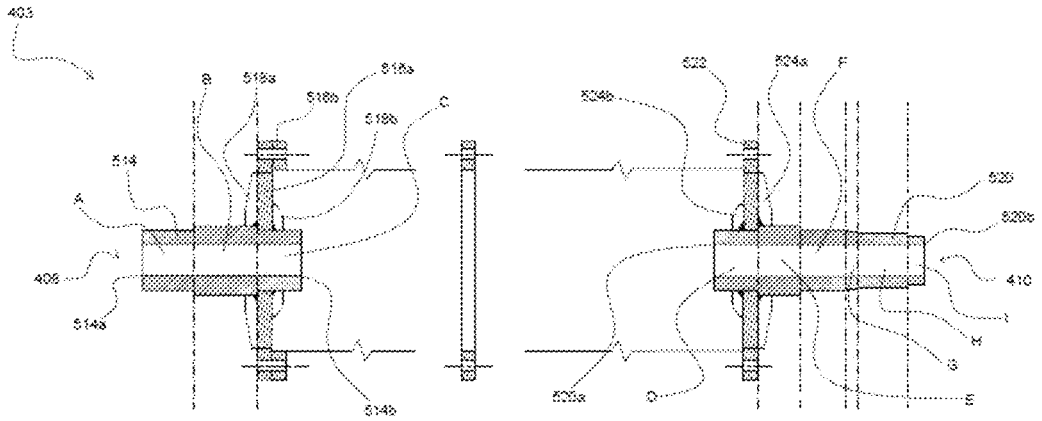

FIG. 5D illustrates a side sectional view of the tumbler assembly of the apparatus of the FIG. 4, in accordance with an embodiment of the present disclosure.

It should be noted that the accompanying figures are intended to present illustrations of exemplary embodiments of the present disclosure. These figures are not intended to limit the scope of the present disclosure. It should also be noted that accompanying figures are not necessarily drawn to scale.

DETAILED DESCRIPTION

Reference will now be made in detail to selected embodiments of the present disclosure in conjunction with accompanying figures. The embodiments described herein are not intended to limit the scope of the disclosure, and the present disclosure should not be construed as limited to the embodiments described. This disclosure may be embodied in different forms without departing from the scope and spirit of the disclosure. It should be understood that the accompanying figures are intended and provided to illustrate embodiments of the disclosure described below and are not necessarily drawn to scale. In the drawings, like numbers refer to like elements throughout, and thicknesses and dimensions of some components may be exaggerated for providing better clarity and ease of understanding.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

FIG. 1A illustrates an internal perspective view of an apparatus 100 for pressing and dehydrating of a pre-defined amount of waste, in accordance with various embodiments of the present disclosure. The apparatus 100 is a mechanical device configured to press and dehydrate the pre-defined amount of the waste. The pre-defined amount of waste is obtained from a plurality of sources. The pre-defined amount of waste includes waste livestock, animal excreta, municipal solid waste, green waste, organic waste and the like. In general, the pre-defined amount of waste primarily includes large solid mass of waste along with liquid content. In general, the apparatus 100 is an industrial presser designed to press and dehydrate the pre-defined amount of waste.

The apparatus 100 includes a main frame 102, a body 104, a plurality of linkage plates 106, a twin screw assembly 103 and a plurality of mesh screens 105. In addition, the apparatus 100 includes an inlet 112, a gear box assembly 114, a chain and sprocket assembly 116 and a driving unit 118 (shown in FIG. 1B and FIG. 1C). In addition, the apparatus 100 includes an outlet 120 and a press housing 122 (shown in FIG. 1B and FIG. 1C). The above mentioned parts of the apparatus 100 are designed and assembled to perform pressing and dehydrating of the pre-defined amount of waste.

Further, the apparatus 100 is substantially positioned along a longitudinal axis. The apparatus 100 is rigidly supported by the main frame 102. The main frame 102 is a metallic frame positioned to provide support to the apparatus 100. Further, the main frame 102 includes a plurality of balance points. Each of the plurality of balance points is distributed discreetly across the main frame 102. Moreover, the main frame 102 includes a first section for holding the body 104 of the apparatus 100. In addition, the main frame 102 includes a second section for holding the driving unit 118 (shown in the FIG. 1B and FIG. 1C).

The main frame 102 has a pre-defined length (A) (shown in FIG. 1B) to rigidly support the apparatus 100. In an embodiment of the present disclosure, the pre-defined length is 3680 mm. In another embodiment of the present disclosure, the pre-defined length is 4010 mm. In yet another embodiment of the present disclosure, the pre-defined length is 5700 mm.

The body 104 is aligned along the longitudinal axis of the apparatus 100. The body 104 includes a plurality of vertical rigid supports 104*a*-104*h* and one or more horizontal rigid supports 104*i*. The plurality of vertical rigid supports 104*a*-104*h* is mounted perpendicular to the longitudinal axis of the apparatus 100. In addition, the plurality of vertical rigid supports 104*a*-104*h* is mounted vertically to the main frame 102 of the apparatus 100. The plurality of vertical rigid supports 104*a*-104*h* provides vertical support to the apparatus 100. Moreover, the one or more horizontal rigid supports 104*i* are mounted along the longitudinal axis of the apparatus 100.

Furthermore, the body 104 is mechanically linked to the main frame 102 through the plurality of linkage plates 106. Moreover, the plurality of linkage plates 106 is horizontally positioned on the main frame 102. The plurality of linkage plates 106 is assembled discreetly across the main frame 102. Moreover, the plurality of linkage plates 106 is a metallic plate designed to provide a rigid and flat base for assembled parts of the apparatus 100. The body 104 includes a first plurality of holes. In addition, each linkage plate of the plurality of linkage plates 106 has a second plurality of holes designed to couple with a mountable part of the apparatus 100. In an embodiment of the present disclosure, the body 104 is the mountable part of the apparatus 100. The second plurality of holes of each linkage plate of the plurality of linkage plates 106 is aligned with the first plurality of holes of the body 104. Moreover, the body 104 is mechanically linked through insertion of a plurality of bolts inside the aligned first plurality of holes and the second plurality of holes.

Furthermore, a capacity to process the pre-defined amount of waste is based on a material handling capacity of the inlet 112 (as shown in FIG. 1B and FIG. 1C). In an embodiment of the present disclosure, the capacity of the apparatus 100 to process the pre-defined amount of waste is 350 tons per day. In another embodiment of the present disclosure, the capacity to process the pre-defined amount of the organic waste is 400 tons per day. In yet another embodiment of the present disclosure, the capacity to process the pre-defined amount of the organic waste is 800 tons per day.

Going further, the plurality of mesh screens 105 is rigidly linked to the body 104 along the longitudinal axis. The plurality of mesh screens is linked to the body 104 through the plurality of vertical rigid supports 104*a*-104*h*. In addition, the plurality of mesh screens is linked to the body 104 through the one or more horizontal rigid supports 104*i*. Moreover, the plurality of mesh screens 105 encapsulates the twin screw assembly 103. Each mesh screen of the plurality of mesh screens 105 has a pre-defined shape. In an embodiment of the present disclosure, the pre-defined shape of the plurality of mesh screens 105 is cylindrical. In another embodiment of the present disclosure, the pre-defined shape of the plurality of mesh screens 105 is cuboidal. In yet another embodiment of the present disclosure, each of the plurality of mesh screens 105 may have any suitable shape.

FIG. 1B illustrates a side profile view of the apparatus of the FIG. 1A, in accordance with an embodiment of the present disclosure. The inlet 112 is vertically mounted on the body 104 of the apparatus 100. The inlet 112 includes ingress cross-sectional opening 112*a* for receiving the pre-defined amount of waste. In addition, the inlet 112 includes an egress cross-sectional opening 112*b* for transferring the pre-defined amount of waste to the twin screw assembly 103. In an embodiment of the present disclosure, the ingress cross-sectional opening 112*a* is positioned above the egress cross-sectional opening 112*b*.

Further, the pre-defined amount of waste is gravitationally fed to the twin screw assembly 103 through the inlet 112. The pre-defined amount of waste is trapped between a first screw 124 and a second screw 126 (shown in FIG. 1C) of the twin screw assembly 103. Moreover, the twin screw assembly 103 compresses the pre-defined amount of waste with each rotation. In addition, the twin screw assembly 103 compresses the pre-defined amount of waste efficiently at a pre-defined speed of rotation. The pre-defined speed of rotation is controlled by the gear box assembly 114. The gear box assembly 114 is coupled to a first screw shaft 126*a* and a second screw shaft 128*a* (shown in FIG. 1C) of the twin screw assembly 103. In addition, the gear box assembly 114 is coupled to the chain and sprocket assembly 116. Moreover, the gear box 114 receives power from the driving unit 118. The gear box 114 receives the power from the driving unit 118 through the chain and sprocket assembly 116.

The driving unit 118 is positioned adjacent to the body 104 of the apparatus 100. In an embodiment of the present disclosure, the driving unit 118 is an electric motor. In another embodiment of the present disclosure the driving unit 118 is an engine. The driving unit 118 includes a driving shaft 118*a* and a driving unit mount 118*b*. The driving unit 118 is coupled with the driving shaft 118*a*. The driving unit 118 is configured to supply the power to the twin screw assembly 103 at a pre-defined rate of rotation. In addition, the driving shaft 118*a* is coupled to the chain and sprocket assembly 116. Moreover, the chain and sprocket assembly 116 is configured to transfer the power to the gear box 114.

In an embodiment of the present disclosure, the driving unit 118 is a direct current based motor. In another embodiment of the present disclosure, the driving unit 118 is an alternating current motor. Moreover, the pre-defined rate of rotation of the driving unit 118 may be controlled in any manner. In an embodiment of the present disclosure, the driving unit 118 is controlled through an automatic feedback based controller. In another embodiment of the present disclosure, the driving unit 118 is controlled through a manual switch based controller.

Furthermore, the driving unit 118 is mounted on the driving unit mount 118*b*. The driving unit mount 118*b* is positioned adjacent to the body 104 and mounted on the first section of the main frame 102. The driving unit mount 118*b* includes a plurality of holders designed to mount the driving unit 118. Moreover, the outlet 120 includes a press liquid outlet 120*a* and a press solid outlet 120*b*. The press liquid outlet 120*a* is mechanically linked to the main frame 102 of the apparatus 100. The press liquid outlet 120*a* is configured to expel a compressed liquid content of the pre-defined amount of waste. In addition, the press solid outlet 120*b* is mechanically linked to the main frame 102 at the second end of the body 104. The press solid outlet 120*b* is configured to expel a compressed solid waste of the pre-defined amount of waste.

Further, the press housing 122 encloses the body 104, the twin screw assembly 103 and the plurality of mesh screens 105. The press housing 122 has a pre-defined shape. In an embodiment of the present disclosure, the pre-defined shape of the plurality of mesh screens 105 is cylindrical. In another embodiment of the present disclosure, the pre-defined shape of the plurality of mesh screens 105 is cuboidal. In yet another embodiment of the present disclosure, each of the plurality of mesh screens 105 may have any suitable shape. Further, the press housing 122 is made of a metal or an alloy. In an embodiment of the present disclosure, the metal used for construction of the press housing 122 is steel. In another embodiment of the present disclosure, the metal used for construction of the press housing 122 is galvanized iron. In yet another embodiment of the present disclosure, any suitable metal or alloy may be used for the construction of the press housing 122.

FIG. 1C illustrates a rear profile view of the apparatus of the FIG. 1A, in accordance with another embodiment of the present disclosure. The first screw 124 and the second screw 126 extends outside the body 104. A first annular base plate 128 supports the first screw 124. In addition, the first annular base plate 128 is configured to align properly with the first screw 124. Moreover, a second annular base plate 130 supports the second screw 126. In addition, the second annular base plate 130 is configured to align properly with the second screw 126.

Furthermore, the apparatus 100 has a pre-defined height (shown as B in FIG. 1B), a pre-defined length (shown as A in FIG. 1B) and a pre-defined width (shown as C in FIG. 1C). In an embodiment of the present disclosure, the apparatus 100 has the pre-defined height (B) of 2110 millimeters, the pre-defined length (A) of 4565 millimeters and the pre-defined width (C) of 1315 millimeters. In another embodiment of the present disclosure, the apparatus 100 has the pre-defined height (B) of 2115 millimeters, the pre-defined length (A) of 4850 millimeters and the pre-defined width (C) of 1330 millimeters. In yet another embodiment of the present disclosure, the apparatus 100 has the pre-defined height (B) of 2650 millimeters, the pre-defined length (A) of 6850 millimeters and the pre-defined width (C) of 1840 millimeters.

In addition, the driving unit 118 operating the twin screw assembly 103 in the apparatus 100 consumes a pre-defined amount of power. In an embodiment of the present disclosure, the pre-defined amount of the power is 37 kilowatt for the capacity of 350 tons per day. In another embodiment of the present disclosure, the pre-defined amount of power is 45 kilowatt for the capacity of 400 tons per day. In yet another embodiment of the present disclosure, the pre-defined amount of power is 55 kilowatts for the capacity of 800 tons per day.

FIG. 2A illustrates a perspective view of the twin screw assembly 103 of the apparatus of the FIG. 1A, in accordance with an embodiment of the present disclosure. The twin screw assembly 103 includes the first screw 124 and the second screw 126. The first screw 124 and the second screw 126 are positioned along the longitudinal axis of the apparatus 100. Further, the first screw 124 and the second screw 126 include a first end 202 and a second end 204. In an embodiment of the present disclosure, the first end 202 is a near end. In an embodiment of the present disclosure, the second end 204 is a far end.

Further, the first screw 124 includes a first screw shaft 206 and a first plurality of helical ridges 208. The first screw shaft 206 extends from the first end 202 to the second end 204. Moreover, the first screw shaft 206 has a first pre-defined size at the first end 202. In addition, the first screw shaft 206 has a second pre-defined size at the second end 204. In an embodiment of the present disclosure, the first pre-defined size at the first end 202 is greater than the second pre-defined size at the second end 204 (shown in FIG. 2B). Moreover, the first screw shaft 206 is coupled to the gear box assembly 114.

The first plurality of helical ridges 208 is mounted on the first screw shaft 206. In an embodiment of the present disclosure, the first plurality of helical ridges 208 has a right hand thread. In another embodiment of the present disclosure, the first plurality of helical ridges 208 has a left hand thread. Furthermore, the first plurality of helical ridges 208 has a first pre-defined progressive pitch. The first pre-defined progressive pitch varies from the first end 202 to the second end 204. In an embodiment of the present disclosure, the first pre-defined progressive pitch is 120° at the first end 202. In an embodiment of the present disclosure, the first pre-defined progressive pitch is 95° at the second end 204.

Further, the second screw 126 includes a second screw shaft 210 and a second plurality of helical ridges 212. The second screw shaft 210 extends from the first end 202 to the second end 204. Moreover, the second screw shaft 210 has a third pre-defined size at the first end 202. In addition, the second screw shaft 206 has a fourth pre-defined size at the second end 204. In an embodiment of the present disclosure, the third pre-defined size at the first end 202 is greater than the fourth pre-defined size at the second end 204 (shown in FIG. 2B). Moreover, the second screw shaft 210 is coupled to the gear box assembly 114.

The second plurality of helical ridges 212 is mounted on the second screw shaft 210. In an embodiment of the present disclosure, the second plurality of helical ridges 212 has a left hand thread. In another embodiment of the present disclosure, the second plurality of helical ridges 212 has a right hand thread. Furthermore, the second plurality of helical ridges 212 has a second pre-defined progressive pitch. The second pre-defined progressive pitch varies from the first end 202 to the second end 204. In an embodiment of the present disclosure, the second pre-defined progressive pitch is 120° at the first end 202. In an embodiment of the present disclosure, the second pre-defined progressive pitch is 95° at the second end 204. In an embodiment of the present disclosure, the first plurality of helical ridges 208 and the second plurality of helical ridges 212 partially overlap each other.

FIG. 3 illustrates a part perspective view of the plurality of mesh screens 105 of the apparatus of FIG. 1A, in accordance with an embodiment of the present disclosure. The plurality of mesh screens 105 is rigidly linked to the body 104 along the longitudinal axis (as shown in FIG. 1A). The plurality of mesh screens 105 is linked to the body 104 through the plurality of vertical rigid supports 104*a*-104*h* (as shown in FIG. 1A). In addition, the plurality of mesh screens 105 is linked to the body 104 through the one or more horizontal rigid supports 104*i* (as shown in FIG. 1A). Moreover, the plurality of mesh screens 105 encapsulates the twin screw assembly 103. The plurality of mesh screens 105 is configured to remove the compressed liquid content of the pre-defined amount of waste. In an embodiment of the present disclosure, the plurality of mesh screens 105 is a stainless steel mesh screen.

Further, the plurality of mesh screens 105 includes a primary mesh screen 302 and a secondary mesh screen 304. In an embodiment of the present disclosure, the secondary mesh screen 304 surrounds the primary mesh screen 302 circumferentially. The primary mesh screen 302 has a first plurality of apertures. The first plurality of apertures has a first pre-defined nominal diameter range. In an embodiment of the present disclosure, the first pre-defined nominal diameter range is 2 mm-4 mm. Moreover, the secondary mesh screen 304 has a second plurality, of fishers apertures. The second plurality of apertures has a second pre-defined nominal diameter range. In an embodiment of the present disclosure, the second pre-defined nominal diameter range is 6 mm-8 mm.

FIG. 4 illustrates a side profile view of another apparatus 400 for drying the pre-defined amount of waste, in accordance with an embodiment of the present disclosure. The apparatus 400 is a mechanical machine configured to collect and dry the pre-defined amount of the waste. The apparatus 400 utilizes indirect dry steam to kill bacteria and viruses present in the pre-defined amount of waste. In general, the apparatus 400 is an industrial dryer designed to dry the pre-defined amount of waste.

Further, the apparatus 400 includes a machinery frame 402, a heating chamber 401, a meal inlet 404, a tumbler assembly 403 (shown in FIG. 5) and a motor 406. In addition, the apparatus 400 includes a steam inlet 408, a steam outlet 410, a processed material outlet 412 and a dryer housing 414. The apparatus 400 is rigidly supported by the machinery frame 402. The machinery frame 402 is a metallic frame positioned to provide support to the apparatus 400.

Further, the meal inlet 402 is mounted vertically to the heating chamber 401. The meal inlet includes a feed inlet section 404*a* and a feed discharge section 404*b*. The meal inlet 404 receives the pre-defined amount of waste through the feed inlet section 404*a*. In addition, the meal inlet 404 transfers the pre-defined amount of waste to the heating chamber 401 through the feed discharge section 404*b*. In an embodiment of the present disclosure, the feed inlet section 404*a* and the feed discharge section 404*b* of the meal inlet 404 has a rectangular cross-section. It may be noted that the meal inlet 404 has a rectangular cross-section; however, those skilled in the art would appreciate that the feed inlet section 404*a* and the feed discharge section 404*b* of the meal inlet 404 may have any cross section. The feed inlet section 404*a* of the meal inlet 404 is open vertically upwards. Moreover, the heating chamber 401 is a metallic chamber positioned adjacent to the length of the apparatus 400. In addition, the heating chamber 401 is rigidly linked to the machinery frame 402.

The heating chamber 401 is a hollow cylinder with a pre-defined nominal diameter. In an embodiment of the present disclosure, the pre-defined nominal diameter is 2880 mm. In addition, the heating chamber 401 has a pre-defined heating surface area. In an embodiment of the present disclosure, the pre-defined heating surface area is 370 square meter. In another embodiment of the present disclosure, the pre-defined heating surface area is 422 square meter. In addition, the weight of the apparatus 400 depends on the material handling capacity of the heating chamber 401. In an embodiment of the present disclosure, the weight of the apparatus 400 is 28000 kilograms. In another embodiment of the present disclosure, the weight of the apparatus 400 is 30000 kilograms.

Further, the heating chamber 401 encloses the tumbler assembly 403 (shown in FIG. 5). The tumbler assembly 403 is positioned along a longitudinal axis of the heating chamber 401. The tumbler assembly 403 (shown in FIG. 5) is configured to dry the pre-defined amount of waste. In addition, the tumbler assembly 403 (shown in FIG. 5) rotates at a pre-defined speed to dry the pre-defined amount of waste. The tumbler assembly 403 (shown in FIG. 5) is connected to the motor 406. The motor 406 is an electric motor designed to rotate at a pre-defined speed. Moreover, the motor 406 includes a motor shaft. The motor shaft is attached to the tumbler assembly 403 (shown in FIG. 5). The motor shaft is positioned to rotate the tumbler assembly 403 at a pre-defined range of a speed of rotation.

In an embodiment of the present disclosure, the motor 406 is an alternating current motor. In another embodiment of the present disclosure, the motor 406 is a direct current motor. In addition, the motor 406 is connected through a motor controller. The motor controller directs electric power and provides regulated current to the motor 406. The regulated current determines a rate of rotation of the motor 406. In an embodiment of the present disclosure, the motor controller is a manual controller. In another embodiment of the present disclosure, the motor controller is an automatic controller.

Going further, the tumbler assembly 403 is mechanically connected to the steam inlet 408. The steam inlet 408 is positioned at a third end (shown in FIG. 5) of the tumbler assembly 403. The steam inlet 408 collects a pre-defined amount of dry steam from a steam boiler. The steam inlet 408 is designed to collect the pre-defined amount of dry steam inside a hollow shaft (shown in FIG. 5) of the tumbler assembly 403. Moreover, the steam outlet 410 is positioned at a fourth end (shown in FIG. 5) of the tumbler assembly 403. The steam outlet 410 is positioned along an axis synchronized with the longitudinal axis of the heating chamber 401. Further, the steam outlet 410 is internally connected to the tumbler assembly 403 (shown in FIG. 5). The steam outlet 410 transfers a condensed steam present inside the tumbler assembly 403 to one or more feeding pipes. In addition, the one or more feeding pipes transfer the condensed steam from the tumbler assembly 403 to the steam boiler.

Further, the processed material outlet 412 is substantially attached to a bottom of the heating chamber 401. In addition, the processed material outlet 412 faces downwards with an axis perpendicular to the longitudinal axis of the heating chamber 401. Moreover, the processed material outlet 412 is characterized by a processed material opening. The processed material opening has a rectangular cross section. In an embodiment of the present disclosure, the processed material opening of the processed material outlet 412 may have any cross-section. Further, the processed material outlet 412 is designed to eject the pre-defined amount of organic waste subjected to drying treatment.

Furthermore, the dryer housing 414 is positioned adjacent to the longitudinal axis of the heating chamber 401. The dryer housing 414 is a metallic case designed to enclose the tumbler assembly 403. Moreover, the apparatus 400 has a pre-defined height (shown as B in FIG. 4) and a pre-defined length (shown as A in FIG. 4). In an embodiment of the present disclosure, the apparatus 400 has the pre-defined height (B) of 10080 millimeters and the apparatus length (A) of 11600 millimeters. In another embodiment of the present disclosure, the apparatus 400 has the pre-defined height (B) of 11080 millimeters and the pre-defined length (A) of 12600 millimeters.

Going further, the motor 406 operating the tumbler assembly 403 in the apparatus 400 consumes a pre-defined amount of power. In an embodiment of the present disclosure, the pre-defined amount of the power is 90 kilowatt. In another embodiment of the present disclosure, the pre-defined amount of power is 110 kilowatt.

FIG. 5A illustrates a schematic view of the tumbler assembly 403 of the apparatus of the FIG. 4, in accordance with an embodiment of the present disclosure. The tumbler assembly 403 includes a third end 502, a fourth end 504, a hollow shaft 506, a plurality of group of concentric rings 508, a plurality of reinforcement members 510*a*-510*b*, a plurality of return pipes 512*a*-512*b* and a plurality of angular blocks 513. Moreover, a plurality of parts of the tumbler assembly 403 is designed to efficiently dry the pre-defined amount of waste.

The hollow shaft 506 of the tumbler assembly 403 is positioned along an axis synchronized with the longitudinal axis of the heating chamber 401. The hollow shaft 506 extends from the third end 502 to the fourth end 504 of the tumbler assembly 403. The hollow shaft 506 is designed to receive dry steam from the steam inlet 408 of the apparatus 400. Moreover, the hollow shaft 506 is designed to receive steam at a pre-defined pressure. In an embodiment of the present disclosure, the pre-defined pressure is 6 bars. In addition, the hollow shaft 506 is designed to transfer the condensed steam to the steam outlet 410 of the apparatus 400. Moreover, the hollow shaft 506 is designed to disperse the steam inside the plurality of group of concentric rings 508 of the tumbler assembly 403. In an embodiment of the present disclosure, the hollow shaft 506 is made of non-alloy quality steel. In another embodiment of the present disclosure, the hollow shaft 506 is made of any suitable material. In an embodiment of the present disclosure, the hollow shaft has a pre-defined diameter of 610 mm and a pre-defined length of 9720 mm.

The plurality of group of concentric rings 508 is mechanically mounted to the hollow shaft 506. In an embodiment of the present disclosure, the plurality of group of concentric rings 508 is mounted perpendicular to a longitudinal axis of the hollow shaft 506. In another embodiment of the present disclosure, the plurality of group of concentric rings 508 is oriented slightly off-center with respect to the hollow shaft 506. In yet another embodiment of the present disclosure, the plurality of group of concentric rings 508 is mounted at a pre-defined angular range with respect to the longitudinal axis of the hollow shaft 506. In an embodiment of the present disclosure, the pre-defined angular range is 85°-95°.

Further, each of the plurality of group of concentric rings 508 includes a plurality of concentric rings 508*a*-508*g* (as shown in FIG. 5B). Each of the plurality of group of concentric rings 508 has a pre-defined amount of the plurality of concentric rings. In an embodiment of the present disclosure, the pre-defined amount of the plurality of concentric rings 508*a*-508*g* is in a range of 3-20. Each concentric ring of the plurality of concentric rings 508*a*-508*g* is designed to disperse the steam for efficient drying of the pre-defined amount of waste (as shown in FIG. 5B). In addition, each concentric ring of the plurality of concentric rings 508*a*-508*g* is connected to the hollow shaft 506 through a plurality of pipes. The plurality of pipes is designed to transfer the steam from the hollow shaft 506 to each concentric ring of the plurality of concentric rings 508*a*-508*g* (as shown in FIG. 5B). Moreover, each concentric ring of the plurality of concentric rings 508*a*-508*g* encapsulates a steam injector for regulating steam.

In an embodiment of the present disclosure, each concentric ring of the plurality of concentric rings 508*a*-508*g* is made of non-alloy quality steel. In an embodiment of the present disclosure, each concentric ring of the plurality of concentric rings 508*a*-508*g* has a pre-defined tube diameter of 60 mm (as shown in FIG. 5C). In an embodiment of the present disclosure, concentric ring 508*a* has a pre-defined nominal diameter of 2540 mm. In an embodiment of the present disclosure, concentric ring 508*b* has a pre-defined nominal diameter of 2270 mm. In an embodiment of the present disclosure, concentric ring 508*c* has a pre-defined nominal diameter of 2000 mm. In an embodiment of the present disclosure, concentric ring 508*d* has a pre-defined nominal diameter of 1730 mm. In an embodiment of the present disclosure, concentric ring 508*e* has a pre-defined nominal diameter of 1460 mm. In an embodiment of the present disclosure, concentric ring 508*f* has a pre-defined nominal diameter of 1190 mm. In an embodiment of the present disclosure, concentric ring 508*g* has a pre-defined nominal diameter of 920 mm. In addition, each concentric ring of the plurality of concentric rings 508*a*-508*g* is connected to the plurality of reinforcement members 510*a*-510*b*. Each reinforcement member of the plurality of reinforcement members 510*a*-510*b* is designed to provide rigid strength to the tumbler assembly 403. In addition, each reinforcement member of the plurality of reinforcement members 510*a*-510*b* is rigidly linked to each concentric ring of the plurality of concentric rings 508*a*-508*g*. In an embodiment of the present disclosure, each reinforcement member of the plurality of reinforcement members 510*a*-510*b* is made of hot rolled steel.

Furthermore, the plurality of return pipes 512*a*-512*b* (as shown in FIG. 5B, FIG. 5C) is mechanically connected to each group of the plurality of group of concentric rings 508. In an embodiment of the present disclosure, each return pipe of the plurality of return pipes 512*a*-512*b* is made of the non-alloy quality steel. In another embodiment of the present disclosure, each return pipe of the plurality of return pipes 512*a*-512*b* can be made of any suitable material. In addition, each return pipe of the plurality of return pipes 512*a*-512*b* is connected at a pre-defined distance from each other. In an embodiment of the present disclosure, the pre-defined distance is 50 mm. The plurality of return pipes 512*a*-512*b* (as shown clearly in FIG. 5C) is designed to capture and return the condensed steam to the hollow shaft 506. In an embodiment of the present disclosure, each return pipe of the plurality of return pipes 512*a*-512*b* has a pre-defined nominal diameter of 90 mm (as shown in FIG. 5C). Moreover, each return pipe of the plurality of return pipes 512*a*-512*b* has a pre-defined wall thickness. In an embodiment of the present disclosure, the pre-defined wall thickness is 8 mm. In addition, each return pipe of the plurality of return pipes 512*a*-512*b* is made of a pre-defined material. In an embodiment of the present disclosure, the pre-defined material is a non-alloy quality steel.

The plurality of angular blocks 513 is mechanically mounted to each group of the plurality of group of concentric rings 508. The plurality of angular blocks 513 is mounted at a plurality of angles and at a plurality of positions with respect to each group of the plurality of group of concentric rings 508. The plurality of angular blocks 513 is designed to agitate and move the pre-defined amount of waste forward inside the apparatus 400.

FIG. 5D illustrates a side sectional view of the tumbler assembly 403 of the apparatus of the FIG. 4, in accordance with an embodiment of the present disclosure. In addition, the FIG. 5D illustrates a detailed sectional view of the steam inlet 408 and the steam outlet 410 associated with the tumbler assembly 403. The steam inlet 408 includes an inlet shaft 514, a first inlet flange 516*a*, a second inlet flange, a first inlet support 518*a* and a second inlet support 518*b*. Further, the inlet shaft 514 is a hollow cylindrical shaft designed to allow the steam to enter the hollow shaft 506 at the pre-defined pressure. The inlet shaft 514 is made of a pre-defined material. In an embodiment of the present disclosure, the pre-defined material is AISI 1050 carbon steel. In another embodiment of the present disclosure, the pre-defined material can be any suitable material.

Furthermore, the inlet shaft 514 includes a first inlet end 514*a* and a second inlet end 514*b*. In an embodiment of the present disclosure, the first inlet end 514*a* and a second inlet end 514*b* are positioned at a pre-defined distance of 613 mm from each other. In addition, the inlet shaft 514 includes a section A, a section B and a section C. In an embodiment of the present disclosure, the section A has a pre-defined length of 253 mm and a pre-defined nominal diameter of 220 mm. In an embodiment of the present disclosure, the section B has a pre-defined length of 242 mm and a pre-defined nominal diameter of 250 mm. In an embodiment of the present disclosure, the section C has a pre-defined length of 118 mm and a pre-defined nominal diameter of 240 mm.

The first inlet flange 516*a* and the second inlet flange 516*b* are mounted at the section C of the inlet shaft 514. In an embodiment of the present disclosure, the first inlet flange 516*a* and the second inlet flange 516*b* are made of hot rolled steel. In another embodiment of the present disclosure, the first inlet flange 516*a* and the second inlet flange 516*b* can be made of any suitable material. In an embodiment of the present disclosure, the first inlet flange 516*a* has a nominal diameter of 810 mm and a thickness of 38 mm. In an embodiment of the present disclosure, the second inlet flange 516*b* has a nominal diameter of 810 mm and a thickness of 38 mm. Moreover, a pre-defined number of holes of pre-defined diameter are drilled circumferentially on the first inlet flange 516*a* and the second inlet flange 516*b*. In an embodiment of the present disclosure, the pre-defined number of holes is 24. In an embodiment of the present disclosure, the pre-defined diameter of each hole is 24 mm.

Furthermore, the first inlet support 518*a* and the second inlet support 518*b* are rigidly linked to the section B, the section C, the first inlet flange 516*a* and the second inlet flange 516*b*. The first inlet support 518*a* and the second inlet support 518*b* are designed to rigidly support the first inlet flange 516*a* and the second inlet flange 516*b*. In addition, the first inlet support 518*a* and the second inlet support 518*b* are positioned to rigidly fix the first inlet flange 516*a* and the second inlet flange 516*b*. In an embodiment of the present disclosure, the first inlet support 518*a* and the second inlet support 518*b* are made of the hot rolled steel. In another embodiment of the present disclosure, the first inlet support 518*a* and the second inlet support 518*b* can be made of any suitable material. In an embodiment of the present disclosure, each of the first inlet support 518*a* and the second inlet support 518*b* has a pre-defined thickness of 30 mm.

Going further, the steam outlet 410 includes an outlet shaft 520, an outlet flange 522, a first outlet support 524*a* and a second outlet support 524*b*. The outlet shaft 520 is a hollow cylindrical shaft designed to allow the steam to exit through the hollow shaft 506 at the pre-defined pressure. The outlet shaft 520 is made of a pre-defined material. In an embodiment of the present disclosure, the pre-defined material is AISI 1050 carbon steel. In another embodiment of the present disclosure, the pre-defined material can be any suitable material.

Furthermore, the outlet shaft 520 includes a first outlet end 520*a* and a second outlet end 520*b*. In an embodiment of the present disclosure, the first outlet end 520*a* and a second outlet end 520*b* are positioned at a pre-defined distance of 893 mm from each other. In addition, the outlet shaft 520 includes a section D, section E, section F, section G, section H and section I. In an embodiment of the present disclosure, the section D has a pre-defined length of 118 mm and a pre-defined nominal diameter of 240 mm. In an embodiment of the present disclosure, the section E has a pre-defined length of 243.9 mm and a pre-defined nominal diameter of 250 mm. In an embodiment of the present disclosure, the section F has a pre-defined length of 117.2 mm and a pre-defined nominal diameter of 220 mm. In an embodiment of the present disclosure, the section G has a pre-defined length of 103.9 mm and a pre-defined nominal diameter of 210 mm. In an embodiment of the present disclosure, the section H has a pre-defined length of 250 mm and a pre-defined nominal diameter of 200 mm. In an embodiment of the present disclosure, the section I has a pre-defined length of 60 mm and a pre-defined nominal diameter of 180 mm.

The outlet flange 522 is mounted at the section D of the outlet shaft 520. In an embodiment of the present disclosure, the outlet flange 522 is made of hot rolled steel. In another embodiment of the present disclosure, the outlet flange 522 can be made of any suitable material. In an embodiment of the present disclosure, the outlet flange 522 has a nominal diameter of 810 mm and a thickness of 38 mm. Moreover, a pre-defined number of holes of pre-defined diameter are drilled circumferentially on the outlet flange 522. In an embodiment of the present disclosure, the pre-defined number of holes is 24. In an embodiment of the present disclosure, the pre-defined diameter of each hole is 24 mm.

Furthermore, the first outlet support 524*a* and the second outlet support 524*b* are rigidly linked to the section D, the section E and the outlet flange 522. The first outlet support 524*a* and the second outlet support 524*b* are designed to rigidly support the outlet flange 522. In addition, the first outlet support 524*a* and the second outlet support 524*b* are positioned to rigidly fix the outlet flange 522. In an embodiment of the present disclosure, the first outlet support 524*a* and the second outlet support 524*b* are made of the hot rolled steel. In another embodiment of the present disclosure, the first outlet support 524*a* and the second outlet support 524*b* can be made of any suitable material. In an embodiment of the present disclosure, each of the first outlet support 524*a* and the second outlet support 524*b* has a pre-defined thickness of 30 mm.

Further, the present apparatus has several advantages over the prior art. The present apparatus provides compactly and sophistically pressed and dried waste with an increased processing efficiency. Further, the apparatus derives a lower power with an increased output. Thus, the apparatus provides a higher return of investment and an easier finance of resources. Furthermore, the use of the apparatus has various ecological benefits. The apparatus decreases the volume of the waste. In addition, the apparatus provides a solution to the growing problem of large scale waste dumping. Ultimately, the apparatus leads to a reduction in emissions of greenhouse gases (GHG) and possibly a complete elimination of landfills.

The foregoing descriptions of specific embodiments of the present technology have been presented for purposes of illustration and description. They are not intended to be exhaustive or to limit the present technology to the precise forms disclosed, and obviously many modifications and variations are possible in light of the above teaching. The embodiments were chosen and described in order to best explain the principles of the present technology and its practical application, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

While several possible embodiments of the invention have been described above and illustrated in some cases, it should be interpreted and understood as to have been presented only by way of illustration and example, but not by limitation. Thus, the breadth and scope of a preferred embodiment should not be limited by any of the above-described exemplary embodiments.

What is claimed is:

1. An apparatus for pressing and dehydrating a pre defined amount of waste, the apparatus comprising:

a main frame that provides a rigid support to the apparatus, the main frame is a metallic main frame;

a body that is mechanically linked to the main frame through a plurality of linkage plates, the plurality of linkage plates are discretely positioned horizontally across, on the main frame;

the body includes:

a plurality of rigid support slabs having an upper polygonal configuration portion and a lower polygonal, configuration portion, with a top section of the upper polygonal configuration portion having a trapezoidal form:

the plurality of rigid support slabs include:

a main opening for accommodating a twin screw assembly; and a plurality of peripheral openings;

the plurality of rigid support slabs are spaced-apart and fixed to and mounted vertically to the main frame in parallel via the plurality of linkage plates, with the plurality of rigid support slabs oriented perpendicular a longitudinal axis of the apparatus to, provide vertical support to the apparatus; and a plurality of rigid support bars that are fixed to and mounted perpendicular to the plurality of rigid support slabs via the plurality of peripheral openings of the plurality of rigid support slabs;

the plurality of rigid support bars are oriented horizontally parallel along the longitudinal axis of the apparatus;

the plurality of rigid support bars are comprised of:

lateral bars that are connected to lateral sides of the plurality of rigid support slabs via a lateral opening of the plurality of peripheral openings of the plurality of rigid support slabs; and top bars that are connected to a top side of the plurality of rigid support slabs via top openings of the plurality of peripheral openings of the plurality of rigid support slabs;

the body further includes:

a single bar that cross-connects the top bars, with the single bar oriented perpendicular to the top bars;

an inlet vertically mounted and fixed to a position located on the body;

wherein the inlet comprises an ingress cross-sectional opening for receiving the pre-defined amount of waste and an egress cross-sectional opening for transferring the pre-defined amount of waste to the twin screw assembly;

the twin screw assembly mounted on the main frame and horizontally positioned on the main frame for rotation along the longitudinal axis of the apparatus, wherein the twin screw assembly is configured to press and dehydrate the pre-defined amount of waste; and a plurality of mesh screens rigidly linked to the body via the main opening of the plurality of rigid support slabs and linked to the plurality of rigid support bars, with the plurality of mesh screens oriented along the longitudinal axis of the apparatus, the plurality of mesh screens is comprised of:

a single piece primary mesh screen and a single piece secondary mesh screen;

the secondary, mesh screen surrounds and encapsulates the primary mesh screen circumferentially; and both the primary and secondary mesh screens of the plurality of mesh screens encapsulate the twin screw assembly.

2. The apparatus as recited in claim 1, wherein the main frame comprises a first section for holding the body and a second section for holding a driving unit.

3. The apparatus as recited in claim 2, wherein the driving unit is positioned adjacent to the body and mounted on the second section of the main frame, wherein the driving unit is coupled to a chain and sprocket assembly.

4. The apparatus as recited in claim 2, wherein the driving unit comprises an electric motor assembly.

5. The apparatus as recited in claim 2, wherein the driving unit comprises an engine assembly.

6. The apparatus as recited in claim 1, wherein the twin screw assembly further comprises:

a first screw and a second screw positioned along the longitudinal axis of the apparatus, wherein the first screw and the second screw are mechanically coupled to a driving shaft of a driving unit through a chain and sprocket assembly, wherein the first screw and the second screw comprises a first end and a second end and wherein the first end is a near end and the second end is a far end; and a plurality of helical ridges rigidly mounted on the first screw and, the second screw, wherein each helical ridge of the plurality of helical ridges has a pre-defined progressive pitch varying from the first end to the second end.

7. The apparatus as recited in claim 1, wherein the plurality of mesh screens are stainless steel mesh screens.

8. The apparatus as recited in claim 7, wherein the primary mesh screen comprises a first plurality of apertures, wherein the first plurality of apertures have a first pre-defined nominal diameter range and wherein the first pre-defined nominal diameter range is 2 mm-4 mm.

9. The apparatus as recited in claim 7, wherein the secondary mesh screen comprises a second plurality of apertures, wherein the second plurality of apertures have a second pre-defined nominal diameter range and wherein the second pre-defined nominal diameter range is 6 mm-8 mm.

10. The apparatus as recited in claim 1, further comprising an outlet for expelling a processed waste, wherein the outlet is positioned, at a second end.

11. An apparatus for pressing and dehydrating a pre-defined amount of waste, the apparatus comprising:

a main frame positioned for providing a rigid support to the apparatus, wherein the main frame is a metallic main frame and wherein the main frame comprises a first section and a second section;

a body mechanically linked to the main frame through a plurality of linkage plates, the plurality of linkage plates are discretely positioned horizontally across, on the main frame;

wherein the first section of the main frame holds the body, wherein the body comprises:

a plurality of vertical rigid slabs that are spaced-apart and fixed to and mounted perpendicular a longitudinal axis of the apparatus, wherein the plurality of vertical rigid slabs are mounted vertically to the main frame via the plurality of linkage plates, wherein the plurality of vertical rigid slabs provides vertical support to the apparatus;

the plurality of vertical rigid support slabs having an upper polygonal configuration portion and a lower polygonal configuration portion, with atop section of the upper polygonal configuration portion having a trapezoidal form;

the plurality of vertical rigid support slabs include:

a main opening for accommodating a twin screw assembly; and a plurality of peripheral openings;

one or more horizontal rigid bars that are fixed to and mounted perpendicular to the plurality of vertical rigid support slabs via the plurality of peripheral openings of the plurality of rigid support slabs;

the plurality of rigid support bars are oriented horizontally parallel along the longitudinal axis of the apparatus;

the plurality of rigid support bars are comprised of:

a lateral bar that is connected to a lateral side of the plurality of rigid support slabs via a lateral opening of the plurality of peripheral openings of the plurality of rigid support slabs; and top bars that are connected to a top side of the plurality of rigid support slabs via top openings of the plurality of peripheral openings of the plurality of rigid support slabs;

the body further includes:

a single bar that cross-connects the top bars, with the single bar oriented perpendicular to the top bars;

an inlet vertically mounted and fixed to a position located on the body;

wherein the inlet comprises an ingress cross-sectional opening for receiving the pre-defined amount of waste and an egress cross-sectional opening for transferring the pre-defined amount of waste to the twin screw assembly;

the twin screw assembly mounted on the main frame and horizontally positioned on the main frame for rotation along the longitudinal axis of the apparatus, wherein the twin screw assembly is configured to press and dehydrate the pre-defined amount of waste, wherein the twin screw assembly comprises:

a first screw and a second screw adjacently positioned, horizontally spaced, and extending longitudinally along the longitudinal axis of the apparatus, wherein the first screw and the second screw are mechanically coupled to a driving, shaft of a driving unit through a chain and sprocket assembly, wherein the second section holds the driving unit, wherein the first screw and the second screw comprises a first end and a second end and wherein the first end is a near end and the second end is a far end; and a plurality of helical ridges rigidly mounted on the first screw and the second screw, wherein each helical ridge of the plurality of helical ridges has a pre-defined progressive pitch varying from the first end to the second end;

a plurality of mesh screens rigidly linked to the body via the main opening of the plurality of vertical rigid support slabs and linked to the plurality of rigid support bars, with the plurality of mesh screens oriented along the longitudinal axis of the apparatus, the plurality of mesh screens is comprised of:

a single piece primary mesh screen and a single piece secondary mesh screen;

the secondary mesh screen surrounds and encapsulates the primary mesh screen circumferentially; and both the primary and secondary mesh screens of the plurality of mesh screens encapsulate the twin screw assembly.

12. The apparatus as recited in claim 11, wherein the plurality of mesh screens are stainless steel mesh screens.

13. The apparatus as recited in claim 12, wherein the primary mesh screen comprises a first plurality of apertures, wherein the first plurality of apertures have a first pre-defined nominal diameter range and wherein the first pre-defined nominal diameter range is 2 mm-4 mm.

14. The apparatus as recited in claim 12, wherein the secondary mesh screen comprises a second plurality of apertures, wherein the second plurality of apertures have a second pre-defined nominal diameter range and wherein the second pre-defined nominal diameter range is 6 mm-8 min.

15. The apparatus as recited in claim 11, further comprising an outlet for expelling a processed waste, wherein the outlet is positioned, at the second end.

16. An apparatus for pressing and dehydrating a pre-defined amount of waste, the apparatus comprising:

a main frame positioned for providing a rigid support to the apparatus, wherein the main frame is a metallic main frame and wherein the main frame comprises a first section for holding a body and a second section for holding a driving unit;

the body mechanically linked to the main frame through a plurality of linkage plates, the plurality of linkage plates are discretely positioned horizontally across, on the main frame, and include openings to receive fasteners to secure the body onto the main frame;

the body comprises:

a plurality of vertical rigid support slabs that have an upper polygonal configuration portion and a lower polygonal configuration portion, with a top section of the upper polygonal configuration portion having a trapezoidal form;

the plurality of vertical rigid support slabs include:

a main opening for accommodating a twin screw assembly; and a plurality of peripheral openings;

the plurality of rigid support slabs are spaced-apart and fixed to and mounted vertically to the main frame in parallel via the plurality of linkage plates, with the plurality of rigid support slabs oriented perpendicular a longitudinal axis of the apparatus, wherein the plurality of vertical rigid support slabs provides vertical support to the apparatus; and one or more horizontal rigid support bars that are fixed to and mounted, perpendicular to the plurality of rigid support slabs via the plurality of peripheral openings of the plurality of rigid support slabs along the longitudinal axis of the apparatus;

the plurality of rigid support bars are comprised of:

a lateral bar that is connected to a lateral side of the plurality of rigid support slabs via a lateral opening of the plurality of peripheral openings of the plurality of rigid support slabs; and top bars that are connected to a top side of the plurality of rigid support slabs via top openings of the plurality of peripheral openings of the plurality of rigid support slabs:

the body further includes:

a single bar that cross-connects the top bars, with the single bar oriented perpendicular to the top bars;

an inlet vertically mounted and fixed to a position located on the body;

wherein the inlet comprises an ingress cross-sectional, opening for receiving the pre-defined amount of waste and an egress cross-sectional opening for transferring the pre-defined amount of waste to the twin screw assembly;

the twin screw assembly mounted on the main frame and horizontally positioned for rotation along the longitudinal axis of the apparatus, wherein the twin screw assembly is configured to press and dehydrate the pre-defined amount of waste, wherein the twin screw assembly comprises:

a first screw and a second screw adjacently positioned, horizontally spaced, and extending longitudinally along the longitudinal axis of the apparatus, wherein the first screw and the second screw is mechanically coupled to a driving shaft of the driving unit through a chain and sprocket assembly, wherein the first screw and the second screw comprises a first end and a second end and wherein the first end is a near end and the second end is a far end; and a plurality of helical ridges rigidly, mounted on the first screw and, the second screw, wherein each helical ridge of the plurality of helical ridges has a pre-defined progressive pitch varying from the first end to the second end;

a plurality of mesh screens rigidly linked to the body via the main opening of the plurality of rigid support slabs and linked to the plurality of rigid support bars, with the plurality of mesh screens oriented along the longitudinal axis, wherein each mesh screen of the plurality of mesh screens comprises a plurality of apertures for removing compressed liquid, wherein the plurality of mesh screens encapsulates the twin screw assembly, wherein the plurality of mesh screens comprises a single piece primary mesh screen and a single piece secondary mesh screen, wherein the secondary mesh screen surrounds the primary mesh screen circumferentially and wherein the plurality of mesh, screens are stainless steel mesh screens.

17. The apparatus as recited in claim 16, wherein the primary mesh screen comprises a first plurality of apertures of the plurality of apertures, wherein the first plurality of apertures have a first pre-defined nominal diameter range and wherein the first pre-defined nominal diameter range is 2 mm-4 mm, wherein the secondary mesh screen comprises a second plurality of apertures of the plurality of apertures, wherein the second plurality of apertures have a second pre-defined nominal diameter range and wherein the second pre-defined nominal diameter range is 6 mm-8 mm.

18. The apparatus as recited in claim 16, further comprising an outlet for expelling a processed waste, wherein the outlet is positioned at the second end.

* * * * *